United States Patent [19]

McMillan et al.

[11] Patent Number: 4,485,877

[45] Date of Patent: Dec. 4, 1984

[54] WALL PENETRATING FIRE EXTINGUISHING DEVICE

[75] Inventors: Stewart G. McMillan; Robert W. Steingass; Clyde H. McMillan, all of Valparaiso, Ind.

[73] Assignee: Fire Task Force Innovations, Inc., Valparaiso, Ind.

[21] Appl. No.: 390,750

[22] Filed: Jun. 21, 1982

[51] Int. Cl.[3] ..... A62C 31/22

[52] U.S. Cl. ..... 169/48; 169/52; 239/271; 239/444; 239/543

[58] Field of Search ..... 169/48, 52, 70; 239/271, 288, 444, 543, 544, 545

[56] References Cited

U.S. PATENT DOCUMENTS

| | | | |
|---|---|---|---|
| 2,224,010 | 12/1940 | Barber | 239/271 |
| 2,334,395 | 11/1943 | Dowell et al. . | |
| 2,493,982 | 1/1950 | Lee | 239/544 X |
| 2,675,270 | 4/1954 | Clougherty et al. | 239/444 |
| 2,993,650 | 7/1961 | Badberg . | |
| 3,313,353 | 4/1967 | Williamson et al. | 169/70 X |
| 3,762,645 | 10/1973 | Gendron . | |
| 4,124,077 | 11/1978 | Barge . | |
| 4,147,216 | 4/1979 | Schnepfe, Jr. et al. . | |

FOREIGN PATENT DOCUMENTS

| | | | |
|---|---|---|---|
| 464166 | 4/1937 | United Kingdom | 239/271 |
| 556697 | 10/1943 | United Kingdom | 239/544 |

*Primary Examiner*—Andres Kashnikow

*Attorney, Agent, or Firm*—Marshall, O'Toole, Gerstein, Murray & Bicknell

[57] ABSTRACT

A wall penetrating firefighting device, usable separately or as a part of an attack fire hose nozzle assembly, for penetrating the walls of buildings or other types of barriers to extinguish fires hidden by or within the walls or barriers. The device includes an elongated tubular member that is secured to a casing having a bore therethrough and adapted to be connected to a source of fire extinguishing agent under pressure. A discharge port in the distal end of the penetration member discharges a stream of fire extinguishing agent in a direction generally transverse to the axis of the penetration member when a valve in the casing is shifted to its open position. The distal end of the penetration member is conically tapered to facilitate manually forced penetration thereof through a wall or barrier. A flow converting collar having a plurality of orifices therein may be mounted on the penetration member of the device for movement between an inoperative position spaced from the discharge port and an operative position surrounding the discharge port. When in its operative position, the collar converts the stream of fire extinguishing agent into a large ball-like pattern for protecting the user from radiant heat.

17 Claims, 9 Drawing Figures

WALL PENETRATING FIRE EXTINGUISHING DEVICE

BACKGROUND OF THE INVENTION

This invention relates to firefighting devices, and more particularly relates to a wall penetrating firefighting device for extinguishing fires hidden by a barrier or behind or within the walls of a building, which may be used separately or in combination with a fire hose nozzle, which can be converted for use as a fluid curtain or enlarged pattern generating device for protecting firefighters, and which may serve as a guard to protect the hand of a firefighter when the device is incorporated into a fire hose nozzle.

Description of the Prior Art

Various types and sizes of piercing or penetrating nozzles have been developed to permit firefighters to extinguish hidden fires, such as those that may be present behind or in a barrier, such as the walls of a building, or in piles of combustible material such as coal, sawdust or the like. Some of these devices were nothing more than lengths of pipe to which a fire hose could be attached, or were more elaborate structures which included hardened tips that could be driven through a barrier to reach the site of a hidden fire by striking the device with a sledge hammer or the like.

While such devices have performed their intended function with varying degrees of success, most of them have suffered from the disadvantage of not being substantially instantly available for use by the attack firefighters when needed, due to their size and/or the necessity for removing the attack nozzle from its hose line in order to connect the barrier or wall piercing device to the hose line. In other words, so far as is known, most of the devices heretofore developed for extinguishing hidden fires could not be brought into operation without substantial loss of time or shutting down an active firehose line to permit removal of the attack nozzle and substitution of the wall piercing device therefor.

Extinguishing fires in hidden spaces, while being essential to prevent recurrence after the primary fire has been put out, has heretofore been a time consuming and highly destructive task. This was due to the fact that the extinguishment of hidden fires usually involved the use of hooks, axes, pike poles and the like, to pry or tear away surface materials in order to expose the hidden fire and permit the firefighters to extinguish the same. This technique was also hazardous to the firefighters at the scene.

Accordingly, it is the general object of the present invention to provide a novel and improved fire extinguishing device which overcomes the aforementioned disadvantages and objections of the prior art devices.

Another object is to provide a novel firefighting device which may be incorporated into and become a part of a conventional fire hose attack nozzle so as to be immediately available for use whenever needed.

A more particular object is to provide a novel firefighting device which, in addition to its primary function of piercing a barrier or wall for extinguishing fires hidden thereby or therein, may also be employed to generate a curtain or large pattern of fire extinguishing agent to protect personnel in the vicinity of the device and who are in close proximity to a fire.

Still another object is to provide a novel firefighting device of the foregoing character, which may be used in conjunction with or independently of an associated attack fire hose nozzle to permit firefighters to penetrate the walls of a building, or other barriers, and extinguish fires hidden thereby or therein without impairing or interrupting the operation of the attack nozzle.

A further object is to provide the novel multifunction firefighting device of the character described, which may be used as a hand grip or as a guard to protect the hand of a user who is grasping the grip of the nozzle when the device is not functioning as a fire extinguishing device.

BRIEF SUMMARY OF THE INVENTION

Briefly described, in its broader aspects, the present invention contemplates a novel firefighting device which may be used either separately or as a part of an attack fire hose nozzle assembly to penetrate barriers, such as the walls of buildings or sheet metal enclosures, in order to extinguish fires hidden by or within such barriers. In its more specific aspects, the present invention contemplates a novel firefighting device which may be used either independently or in combination with an attack fire hose nozzle assembly and which may be forced into or through a barrier to extinguish hidden fires while the attack nozzle is in use or shut off. The present invention further contemplates a novel firefighting device which may be rapidly and easily converted for use as a device for generating a curtain or large pattern of fire extinguishing agent for protecting firefighters from the effects of extreme radiant heat. The device, to be hereinafter described in detail, thus comprises an elongated, tubular penetration member having a generally pointed or conically tapered distal end and a proximal end that is secured to a body member having a bore therethrough, the bore providing a flow path for fire extinguishing agent. The interior of the penetration member communicates with a bore in the body member, and manually actuated valve means is mounted in the body member to control and/or shut-off the flow of fire extinguishing agent through the penetration member.

The distal end of the penetration member is provided with at least one discharge port for discharging fire extinguishing agent in a direction generally transverse to the axis of the penetration member. A flow converting collar may be mounted on the penetration member and is shiftable between an inoperative position spaced from the discharge port and an operative position surrounding the discharge port. When in its operative position, orifice means in the collar converts the flow of fire extinguishing agent from the discharge port into a large, ball-like, protective pattern, which extends generally axially and radially outwardly from the distal end of the penetration member. The orifice means includes first and second sets of circumferentially spaced orifices, arranged so that the flows therefrom impinge upon each other and create the aforementioned ball-like pattern. The collar may be rotated while in its operative position on the penetration member in order to change the position of the protective pattern.

When not in use, the device of the present invention may be rotated to a downwardly extending position with respect to the associated fire hose nozzle to function as a guard for the fingers of a user of the nozzle if the latter is equipped with a hand grip or may function as a hand grip if the nozzle is not provided with such a grip.

DETAILED DESCRIPTION

Figure 1:
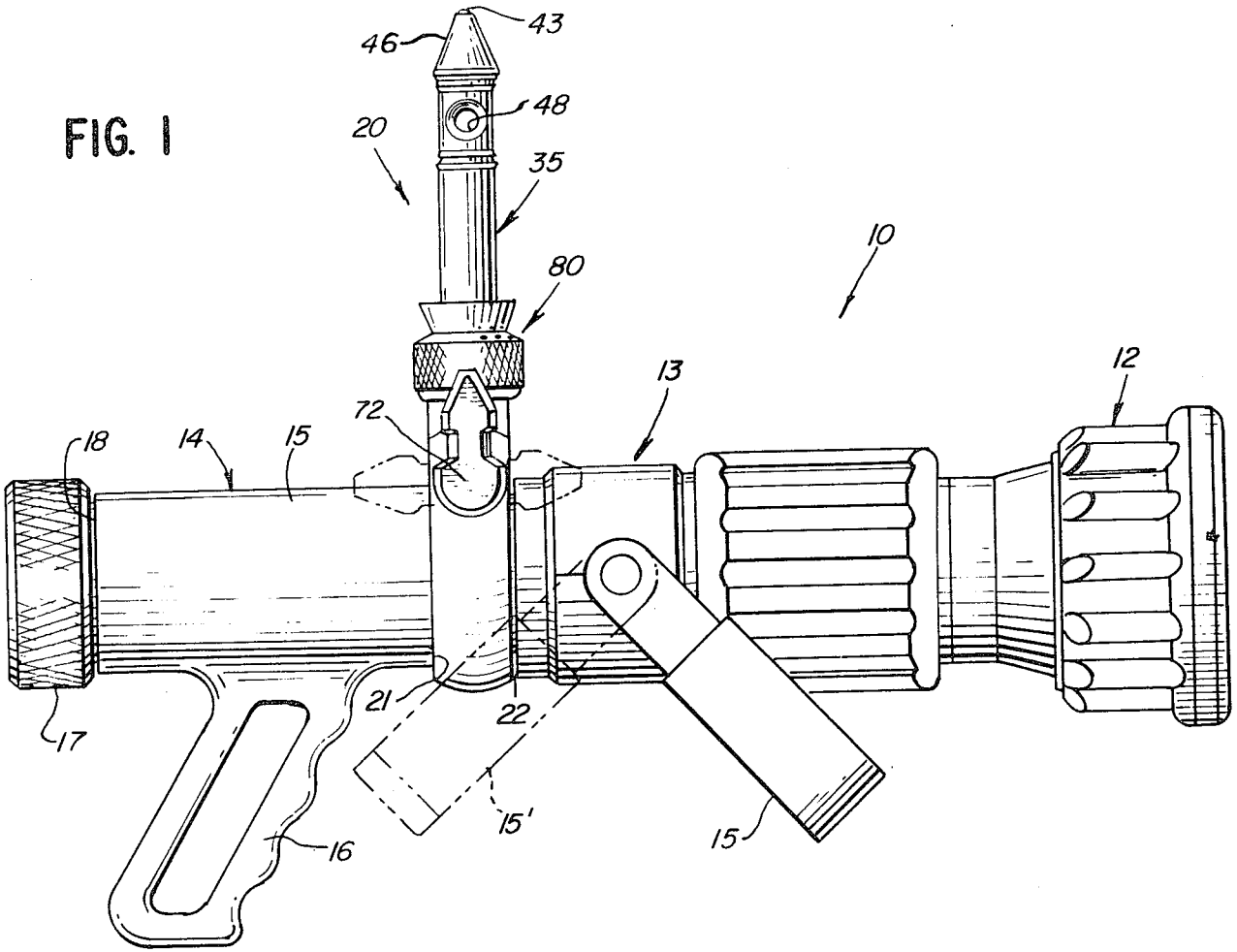
FIG. 1 is a side elevational view of a fire hose nozzle assembly having a firefighting device embodying the features of the present invention incorporated therein and showing the position thereof with respect to the hose nozzle, shut-off valve assembly and pistol grip of the nozzle assembly.

In FIG. 1, a fire hose nozzle assembly is illustrated and indicated generally at 10. The nozzle assembly 10 includes an attack nozzle 12, a flow control and shut-off valve assembly 13, and a handle assembly 14, which, in the present instance, includes a tubular body portion 15 and an integral pistol grip handle 16. A threaded coupling 17, to which a fire hose (not shown) may be connected, is provided at the upstream end, indicated at 18, of the tubular portion 15 of the handle assembly 14.

The nozzle assembly 10 also includes a built-in or integrated wall penetrating fire fighting device, embodying the features of the present invention and indicated generally at 20. The device 20, may be connected to the downstream end, indicated at 21, of the handle assembly 14 by a swivel connection (not shown) and by another swivel connection (also not shown) to the upstream end, indicated at 22, of the valve assembly 13.

Figure 2:
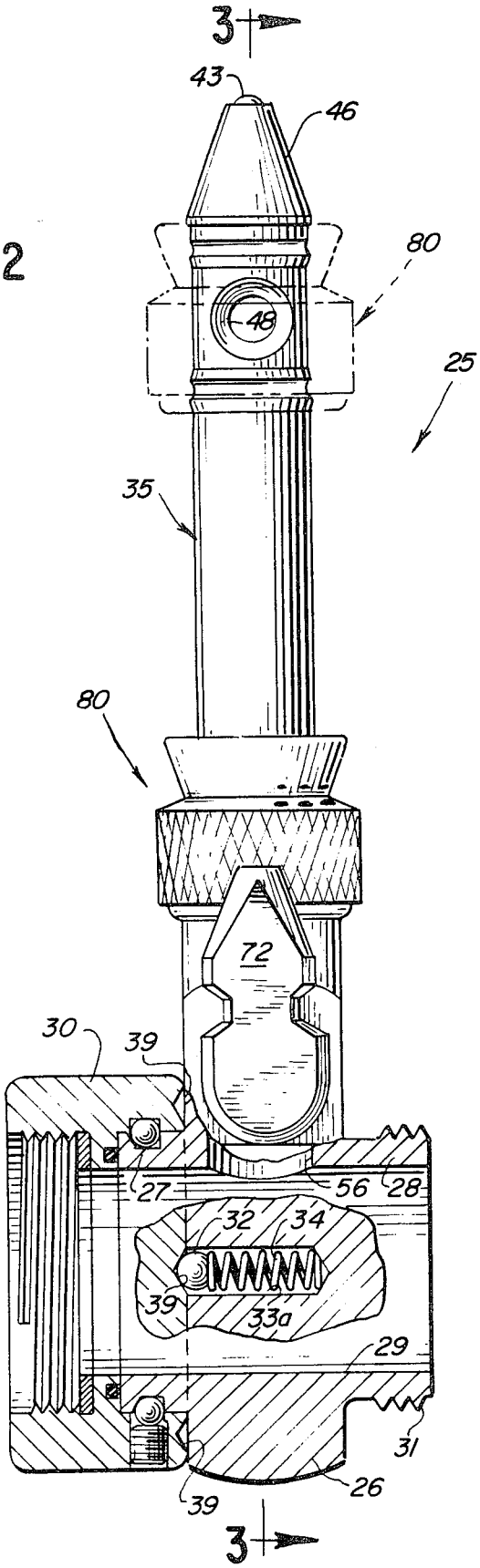
FIG. 2 is an enlarged side elevational view, with some parts in cross section, of a non-integrated form of the wall penetrating firefighting device employed in the fire hose nozzle assembly illustrated in FIG. 1.
Figure 3:
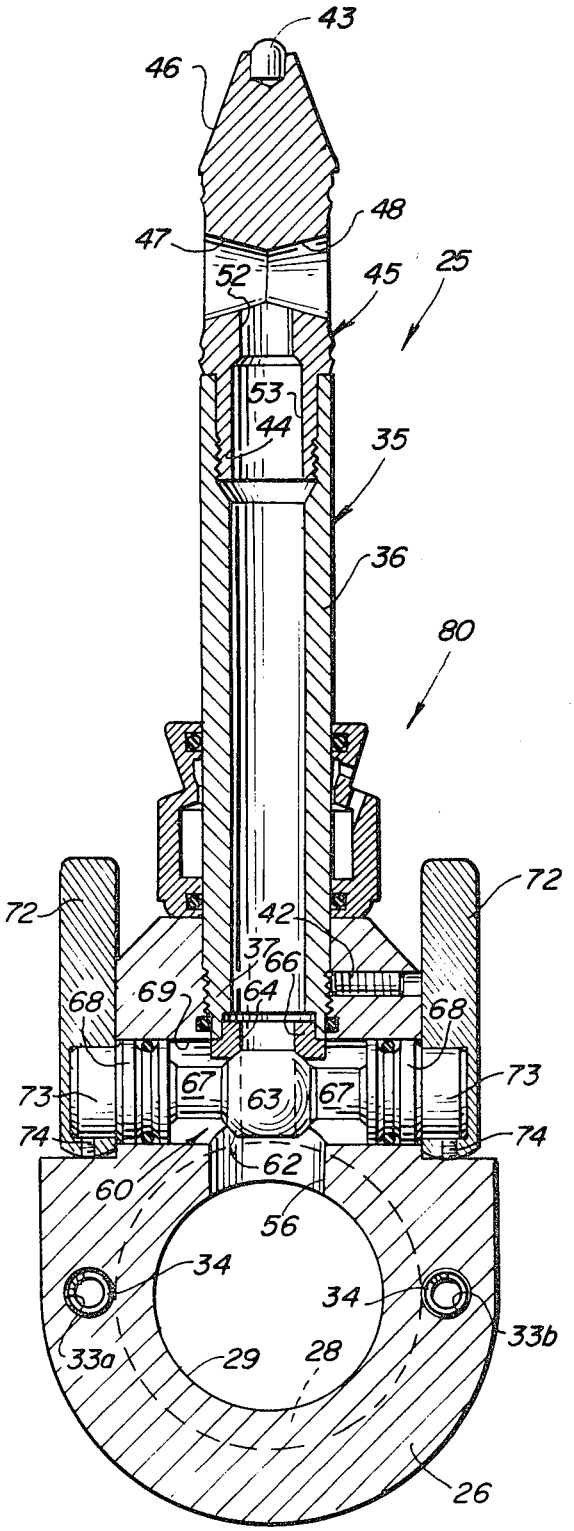
FIG. 3 is a vertical sectional view taken substantially along the line 3—3 of FIG. 2.
Figure 4:
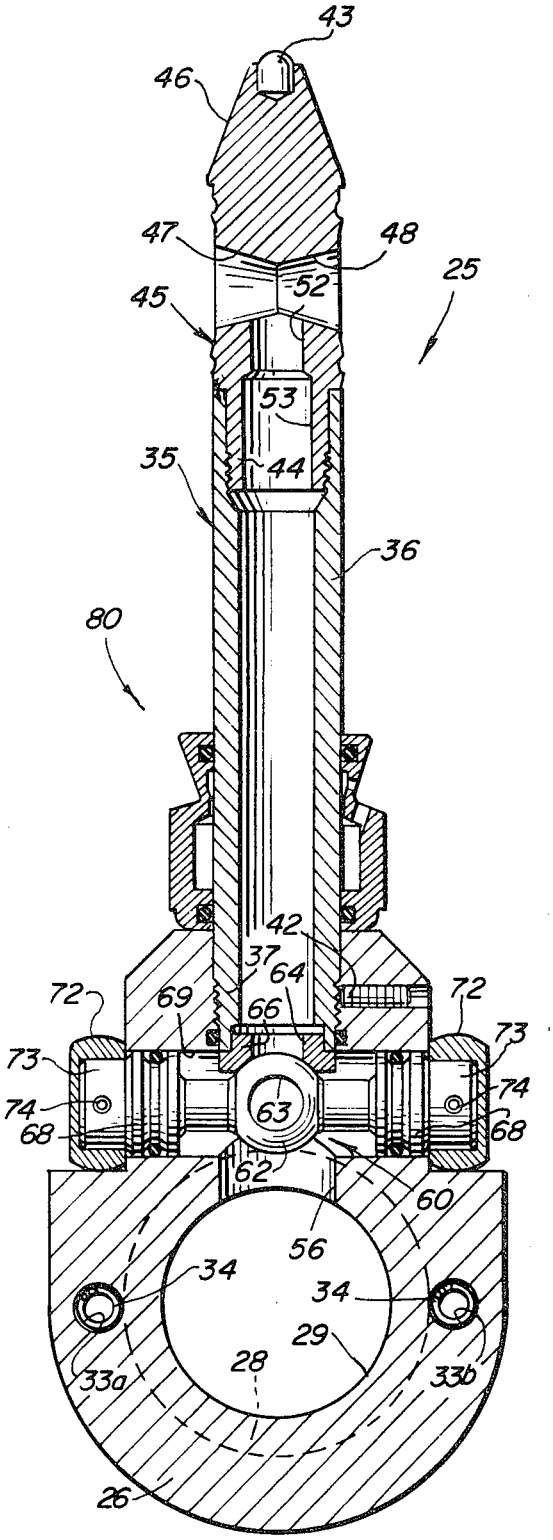
FIG. 4 is a view similar to FIG. 3 but showing the control valve of the device in a closed position.

Referring now to FIGS. 2, 3 and 4, a non-integrated version, indicated generally at 25, of the device 20 shown in FIG. 1 is illustrated. The device 25, which may be incorporated into a hose nozzle assembly, such as the assembly 10, or one or more units thereof connected separately to a hose line, comprises a body member or tubular casing 26 having left and right tubular end portions 27 and 28, respectively, as viewed in FIG. 2, and a bore 29 therethrough. The end portion 27, in the present instance, includes a threaded, swivel coupling 30 which permits the device 25 to be connected to a male hose line fitting or to a handle assembly, similar to the handle assembly 14. The end portion 28, in the present instance, is provided with external threads 31 which permit the end portion 28 to be connected to a female hose line fitting or to a shut-off valve assembly, such as the valve assembly 13.

In order to releasably retain the casing 26 in a selected one of a plurality of rotated positions with respect to the coupling 30, detent means is carried by the casing 26 for this purpose. Such detent means, in the present instance, comprises a pair of balls, one of which is indicated at 32 in FIG. 2, which are respectively mounted in a pair of diametrically spaced, axially extending bores 33*a* and 33*b* in the casing 26. Coil springs 34 bias the balls 32 outwardly and into one of two pairs of circumferentially spaced recesses, one of which is indicated at 39 in FIG. 2, in the adjacent end face of the coupling 30. The arrangement of the recesses is such that the casing 26 will be releasably retained in four rotated positions with respect to the coupling 30, which are 90° from each other. It will be understood that the aforementioned detent means could be arranged to provide different retained positions of the casing 26 relative to the coupling 30, or that the detent means could be eliminated entirely in certain applications.

As best seen in FIGS. 3 and 4, the device 25 comprises an elongated, tubular penetration member 35 having a tube portion 36 having a proximal end 37 that is threaded into the upper end of the casing 26. A set screw 42 serves to secure the penetration 35 in the casing 26. One end 44 of an elongated penetrator head, indicated generally at 45, is threaded into the upper end of the tube portion 36, the unconnected or outer end, indicated at 46, of the head 45 thus comprises the distal end of the penetration member 35.

In order to facilitate passage of the penetration member 35 through a barrier, such as the interior walls of a house or building and through other materials which could hide a fire, such as the sheet metal paneling of vehicles, duct work, cabinets, doors and the like, the outer end 46, of the penetrator head 45 is preferably conically tapered and the remote outer end of the tapered portion 46 is preferably provided with an impact and wear resistant element 43, such as a piece of carbide which is seated in a recess in the outer end 46. Since the penetration member 35 is intended to be forcefully hand driven through barriers of varying degrees of strength, the penetrator head 45 is preferably of stainless steel. The tube portion 36, however, may be of a different material, such as aluminum.

According to the present invention, the device 25 is constructed and arranged to spray a fire extinguishing agent, such as water, Aqueous Film Forming Foam, powders, gases and certain fire extinguishing fluids from the distal end of the penetrator member 35. To this end, at least one and preferably a pair of diametrically arranged, divergent, coaxial discharge ports 47 and 48 are provided in the penetrator head 45 with the axes of the ports 47 and 48 extending perpendicularly to the axis of the tube 36. The ports 47 and 48 intersect an axially extending bore 52 in the penetrator head, the bore 52 being counterbored as at 53 and communicating with the interior of the tube 36. Thus, the interior of the tube 36, and the bores 52 and 53 in the penetrator head 45 comprise a flow passage in the penetration member 35 which connects the discharge ports 47 and 48 with the bore 29 in the casing 26 through an intermediate, transverse bore 56. Thus, when fire extinguishing agent under pressure is being supplied to the interior of the tube 36 of the penetration member 35, two diametrically extending divergent streams of fire extinguishing agent will discharge from the ports 47 and 48. Such streams are indicated at 57 and 58 in FIG. 5.

In order to permit selective operation of the device 25, valve means is provided in the casing 26 for controlling communication between the flow passage in the penetrator member 35 and the connecting bore 56. Such valve means, in the present instance, is indicated generally at 60, and, in the present instance, comprises a ball 62 having a diametric bore 63 therethrough which is movable into and out of registry with an axial bore 64 formed in an annular seat 66 at the lower end of the tube 36. The ball 62 includes a pair of integrally formed shafts 67, the outer ends of which, indicated at 68, are enlarged to provide bearings for journaling the ball valve 62 in a cross bore 69 in the casing 26.

In order to facilitate rotation of the ball valve 62 between its open and closed positions, actuating means in the form of a pair of manually shiftable, arrow-shaped levers 72 (FIGS. 1–4, inclusive), are secured to extensions, indicated at 73, on the outer sides of the bearing 68 as by set screws 74. The arrangement is such that when the levers 72 are in positions extending generally parallel to the penetration member 35, the bore 63 of the ball valve 62 will be in alignment with the interior of the tube 36 and the bore 62. Consequently, fire extinguishing agent in the bore 54 will then be able to flow through the penetration member 35 and discharge out of the ports 47 and 48. Conversely, if either of the levers 72 are shifted to a position perpendicular to the axis of the penetration member 35, as indicated in broken lines in FIG. 1 and in full lines in FIGS. 4 and 6, the bore 63 will be out of registry with the interior of the tube 36 and the intermediate transverse bore 56. Consequently, flow through the penetrator member 35 will then be cut off. It will be understood that under certain conditions, the levers 72 could be shifted to intermediate positions between the full and broken line positions illustrated in FIGS. 3 and 4, respectively, in order to provide a modulated flow from the discharge ports 47 and 48.

Figure 5:
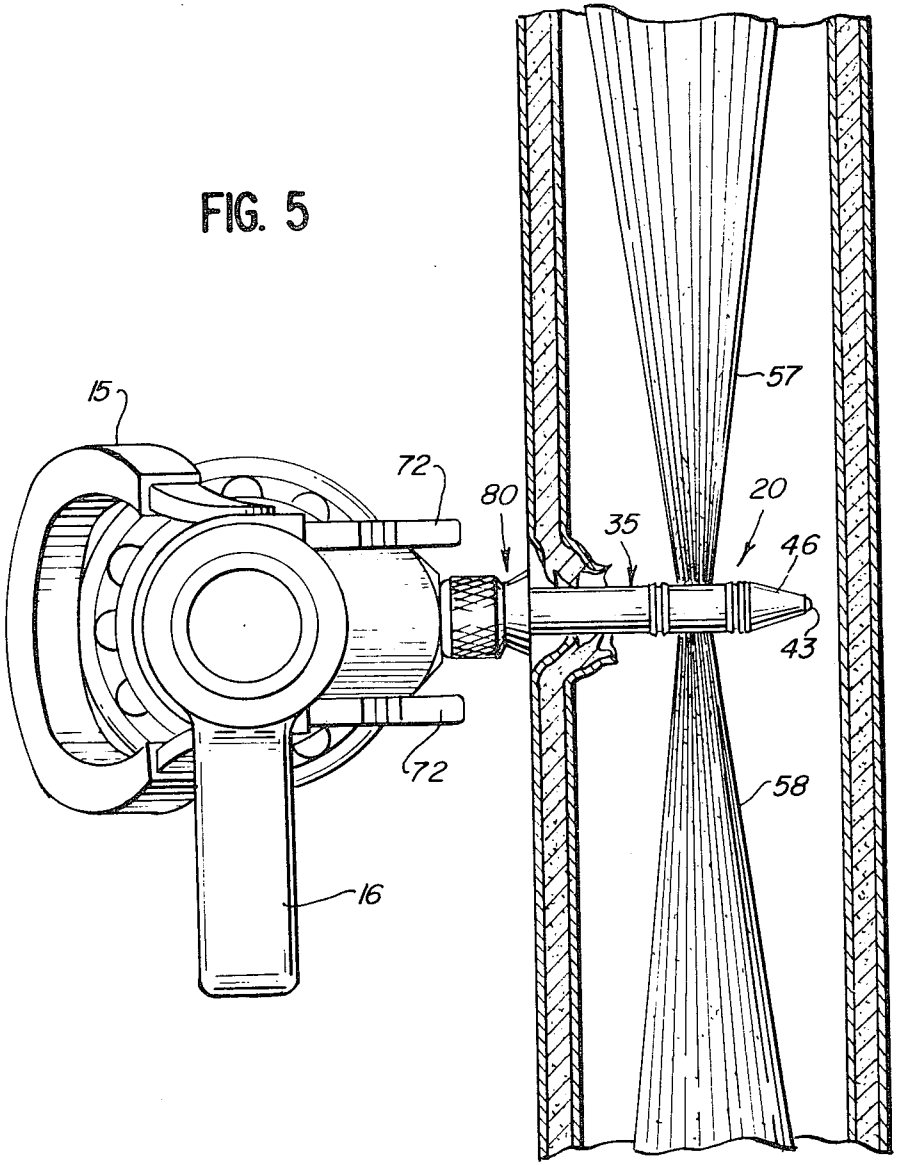
FIG. 5 is a reduced, vertical sectional view showing the firefighting device of the present invention as it would appear when in operation and spraying fire extinguishing agent into the interior of a wall to extinguish a hidden fire.

With the foregoing construction, it will now be apparent that if the firefighter handling a fire hose nozzle assembly, such as the fire hose nozzle assembly 10 that is equipped with the wall penetrating device 25, encounters or suspects that fire may be present on the other side or in a wall of a building, he need only force the penetration member 35 of the device 25 through the wall by applying sufficient force to the casing 26 thereof, or to the nozzle assembly if the device 25 has been connected to or is an integral part of the nozzle assembly, until the penetrator head 45 has passed through the wall, as illustrated in FIG. 5. Thereafter, the operator need only swing one or the other of the handles 72 to their full line, operative positions illustrated in FIGS. 2, 3 and 5, so that fire extinguishing agent will discharge through the ports 47 and 48 to extinguish the hidden fire. To assure this result, the operator may swivel the nozzle assembly or casing 26 around while fire extinguishing agent is being discharged from the ports 47 and 48 in order to assure adequate coverage of the interior of the wall.

In the event that the thickness or material of the wall is such that hand pressure is insufficient to cause the penetration member 35 to pierce the wall, a hole may be made in the wall prior to inserting the member 35 by using a pick, fire ax, wrecking bar or other suitable tool.

The operation is repeated as many times, and at different locations along the barrier or wall, as is necessary to assure adequate saturation of the interior of the wall or other area where hidden fire is suspected.

Figure 7:
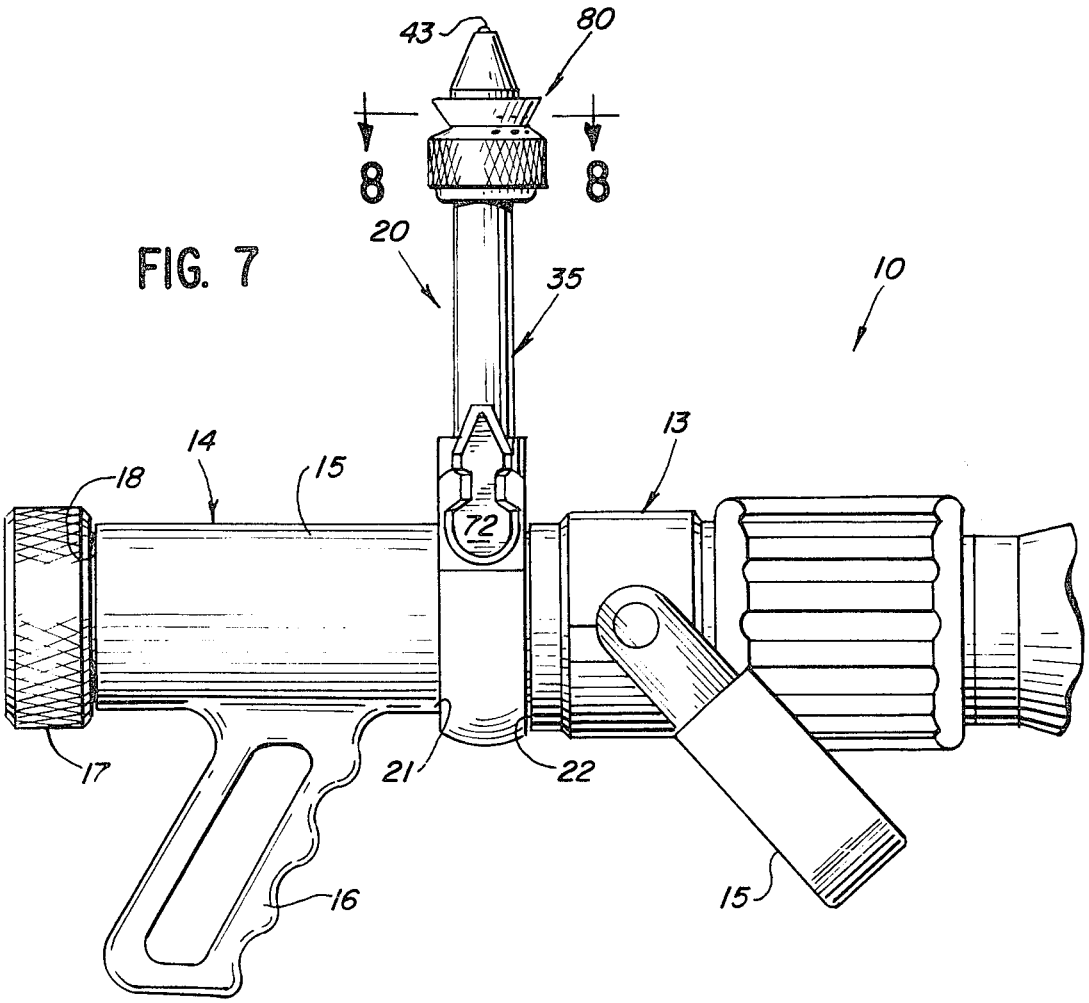
FIG. 7 is a fragmentary, side elevational view of a portion of the nozzle assembly illustrated in FIG. 1, and showing the position of the parts thereof when the firefighting device of the present invention is functioning to generate a protective pattern of fire extinguishing agent.
Figure 9:
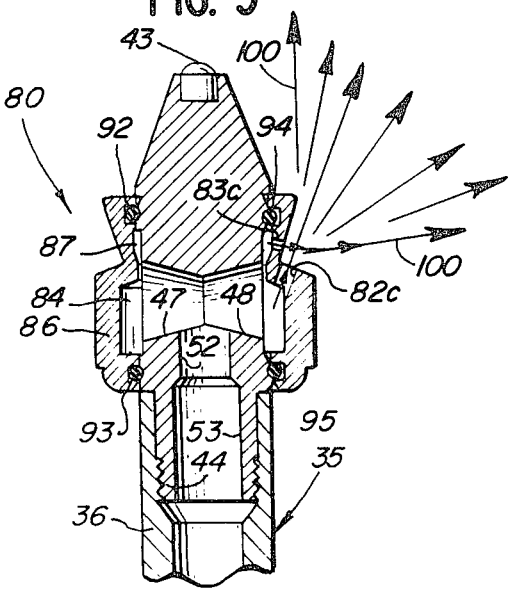
FIG. 9 is a transverse sectional view taken along the line 9—9 of FIG. 8.
Figure 8:
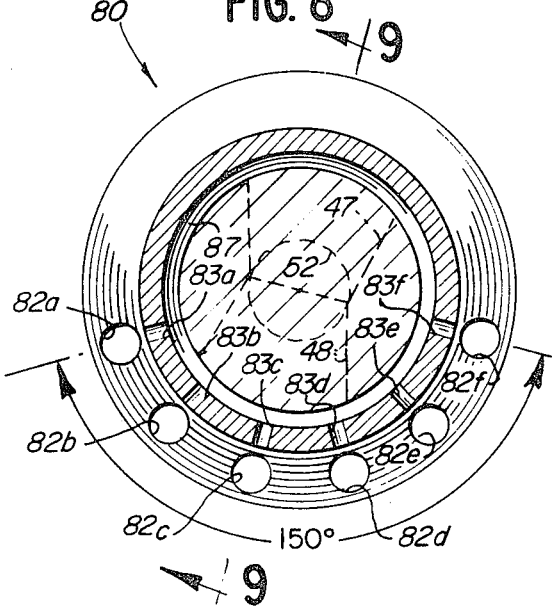
FIG. 8 is a horizontal cross sectional view taken substantially along the line 8—8 of FIG. 7.

Referring now to FIGS. 7, 8 and 9 in conjunction with FIGS. 3 and 4, it will be seen that the wall penetrating, firefighting devices 20 and 25 each includes means, indicated generally at 80, in the form of a collar for converting the flow of fire extinguishing agent from the discharge ports 47 and 48 into a large, ball-like pattern in order to protect firefighters in the vicinity of the devices 20 and 25 from the effects of extreme radiant heat from flames in the attack area. Thus, the collar 80 is mounted on the penetration member 35 for sliding movement therealong between an inoperative position illustrated in full lines in FIGS. 1, 2, 3 and 4, wherein the collar is spaced from the discharge ports 47 and 48, and an operative position, illustrated in phantom lines in FIG. 2 and in full lines in FIGS. 7 and 9, wherein the collar 80 surrounds the discharge ports 47 and 48. When in the latter position, the collar 80 converts the flow from the ports 47 and 48 into at least one and preferably a plurality of impinging jets which provide the aforementiond ball-like pattern or protective curtain.

To this end, the collar 80 includes orifice means in the form of at least one and preferably a first set of equidistantly, circumferentially spaced, upwardly inclined, orifices **82*a*–82*f*, inclusive, and at least one other and preferably a second set of equidistantly, circumferentially spaced, downwardly inclined, orifices 83*a*–83*f*, the orifices 83*a*–83*f* being disposed above and in substantial radial alignment with the orifices 82*a*–82*f* so that the jets of fire extinguishing agent from the orifices 83*a*–83*f* impinge on the jets issuing from the orifices 82*a*–82*f* when the fire extinguishing agent under pressure is being supplied to the wall penetrating member 35. To this end, the inner ends of the orifices 82*a*—82*f* communicate with an annular chamber 84 defined by the exterior of the penetrator head 45 and a radially enlarged portion 86 of the collar 80. The inner ends of the orifices 83*a*–83*f* communicate with a smaller portion 87 of the chamber 84**.

As will be apparent from FIG. 9, the included angle between each pair of the orifices **82*a*–82*f* and 83*a*–83*f* is about 25°. Since 6 orifices are provided in each set, the angle subtended by each set of orifices is about 150°. The angle of diversion of the ball-like pattern from collar 80 is, however, about 180°. It will be understood that the number, direction of extension of the axes and angles between the orifices of each set could be other than as illustrated and described herein. In this regard, the approximate direction of flow of fire extinguishing agent, in a vertical plane as it originates from the orifices 82*a*–82*f* and 83*a*–83*f*, is shown by arrows, indicated at 100, in FIG. 9**.

In order to prevent leakage of fire extinguishing agent from the chambers 84 and 87 when the collar is in its operative position illustrated in FIGS. 7 and 9, a pair of axially spaced circumferentially extending grooves 92 and 93 are provided in the exterior of the penetrator head 45 for receiving O-ring seals 94 and 95, respectively, mounted in grooves in the inner surfaces of the collar 80. The O-ring seals 94 and 95 permit the collar 80 to be rotated on the penetrator head 45 so that the ball-like curtain of fire extinguishing agent generated by the collar can be rotated to a position to maximize protection to firefighters.

Figure 6:
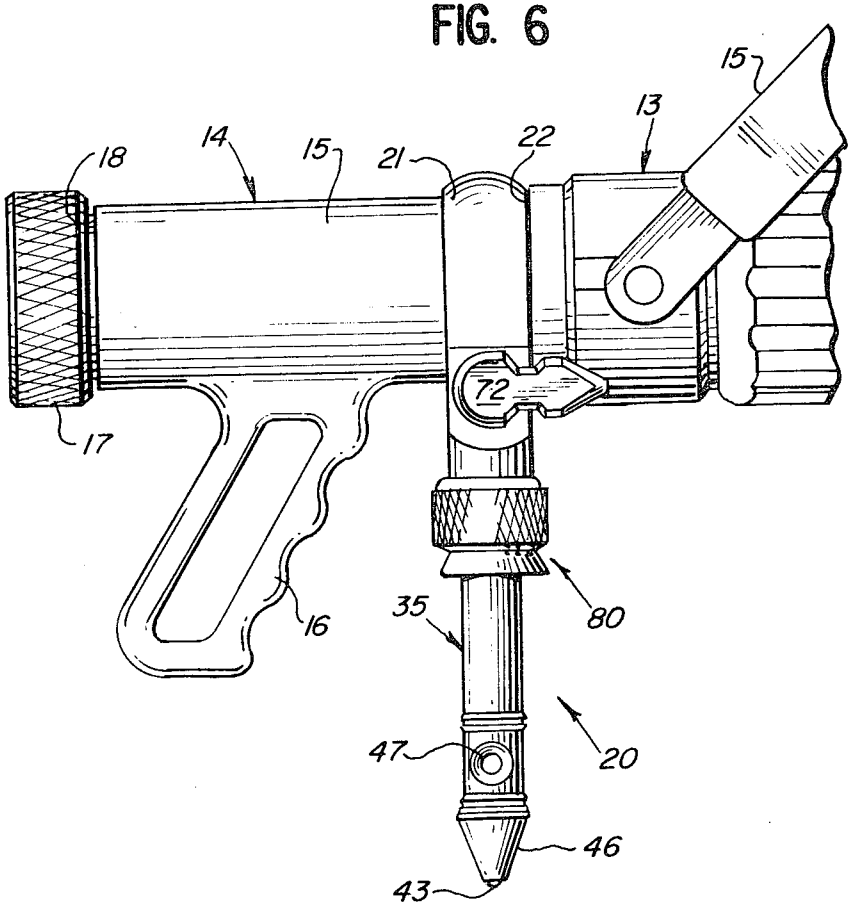
FIG. 6 is a fragmentary side elevational view of a portion of the fire hose nozzle assembly illustrated in FIG. 1 and showing the position of the firefighting device of the present invention as it would appear when the barrier or wall penetrating portion thereof is in a downwardly extending position and functioning as a protective device for the hand of a user of the fire hose nozzle assembly.

While the shut-off handle is illustrated in FIGS. 1 and 6 in its forward or off position, such as to prevent flow through the valve assembly 13 when the collar 80 of the device 13 is in its elevated, operative position and functioning, the handle 15 can, and usually is, in its broken line position 15' in FIG. 1 so that fire extinguishing agent is also discharging from the attack nozzle 12.

When not in use, the device 20 of the fire hose nozzle assembly 10 may be rotated to a downwardly extending position with respect to the support handle assembly 14, as illustrated in FIG. 6. When so positioned, the penetration member 35 of the device 20 functions as a guard to protect the fingers and hand of a firefighter grasping the handle grip 16. In the event that the wall penetrating firefighting device 25 is connected to a nozzle assembly which does not utilize a handle assembly, such as the handle assembly 14, when not in use, the penetration member 35 may be rotated to the position of the device 20 in FIG. 6. The penetration member 35 of the device 25 would then also function as a handle.

While the tube 36 of the penetrating devices 20 and 25 herein illustrated and described is nominally about 4 inches (10.06 cm.) long, longer or shorter length tubes could also be employed. Moreover, instead of a rigid tube, different lengths of flexible hose (e.g. 2 ft., 6 ft., or 20 ft.) could be used.

It should also be understood that while the wall penetrating devices 20 and 25 have been herein illustrated and described as having flow converting collars 80 mounted on the penetrating members 35 thereof, such collars 80 could be omitted.

While one or more embodiments of the invention have been herein illustrated and described, it will be understood that modifications and variations thereof may be developed which do not depart from the spirit of the invention and the scope of the appended claims.

We claim:

1. In combination with a fire hose nozzle assembly adapted to extinguish exposed fires and having an elongated, hollow, nozzle body having inlet and outlet ends and a channel therethrough extending between said ends, said channel providing a flow path for the passage of a fire extinguishing agent through said nozzle body, and a shut-off valve assembly connected to said nozzle body and operable to shut-off flow through said nozzle, the improvement of an elongated, tubular, penetration member having a distal end and a proximal end carried by said nozzle body, the interior of said penetration member providing a flow passage for said fire extinguishing agent, at least one discharge port in said penetration member adjacent to said distal end, one end of said flow passage being connected to said channel in said nozzle body and the opposite end of said flow passage being connected to said discharge port, the distal end of said penetration member being constructed and arranged to facilitate forced penetration of said penetration member through a barrier, such as a wall or the like, and valve means for controlling the flow of fire extinguishing agent through said flow passage, whereby said nozzle assembly may be operated either in a first mode as an attack nozzle to extinguish exposed fires or in a second mode wherein fire extinguishing agent is discharged through said discharge port to extinguish fires on the opposite side of or in said barrier or wall to extinguish hidden fires, or simultaneously in both modes.

2. The fire hose nozzle assembly of claim 1, in which the distal end of said penetration member is carried in a body member having a bore therethrough, said body member is operatively associated with the outlet end of said nozzle body so that the bore in said body member forms a continuation of said channel, and said body member has another bore therein connecting the flow passage in said penetration member with the bore in said body member.

3. The fire hose nozzle assembly of claim 2, in which said valve means for controlling the flow of fire extinguishing agent through the flow passage in said penetration member is carried by said body member.

4. The fire hose nozzle assembly of claim 3, in which shut-off valve means is connected to the inlet end of said nozzle body for shutting off the flow of fire extinguishing agent through said channel, and said body member is connected to the upstream side of said shut-off valve means.

5. The fire hose nozzle assembly of claim 4, in which said body member includes swivel means permitting said body member and said penetration member to be rotated about an axis substantially coextensive with that of said nozzle body, whereby said penetration member can be rotated to different positions with respect to said nozzle body so that use thereof by a firefighter is facilitated.

6. The fire hose nozzle assembly of claim 5, in which said penetration member is rotatable to a downwardly extending position with respect to said nozzle body, whereat said tubular penetration member may be used as a hand grip by a firefighter.

7. The fire hose nozzle assembly of claim 5, in which said nozzle assembly includes tubular handle means having a downstream end connected to the upstream side of said body member, an upstream end adapted to be connected to a source of fire extinguishing agent under pressure, and a hand grip depending therefrom, the interior of said handle means communicates with the interior of said body member, and said penetration member is rotatable to a downwardly extending position in forwardly spaced relation to said hand grip, whereby said penetration member serves to protect the hand of a firefighter grasping said hand grip when said penetration member is substantially in said downwardly extending position.

8. The fire hose nozzle assembly of claim 1, in which flow converting means is mounted on said penetration member and operable to convert the flow of fire extinguishing agent from said discharge port into a large protective pattern extending generally axially and radially from the distal end of said penetration member.

9. The fire hose nozzle assembly of claim 8, in which said flow converting means comprises a slidably mounted collar on said penetrating member, and said collar is shiftable between an operative position surrounding said discharge port and an inoperative position spaced from said discharge port.

10. The fire hose nozzle assembly of claim 9, in which said collar includes orifice means for establishing said protective pattern when said collar is in said operative position.

11. A firefighting device for extinguishing hidden fires on the opposite side of or on a barrier or wall, said device comprising an elongated tubular penetration member having a proximal end adapted to be connected to a source of fire extinguishing agent under pressure and a distal end having at least one lateral discharge port therein for discharging fire extinguishing agent therethrough, said distal end being constructed and arranged to facilitate forced penetration of said penetration member through said barrier or wall and being of a material such as to resist the stress of repeated forced penetration through said barrier or wall, flow converting means mounted on said elongated tubular penetration member for converting flow from said discharge port into a large protected pattern extending generally radially outwardly and axially forwardly from said distal end of said pentration member, said flow converting means comprising a collar mounted on said tubular penetration member and having orifice means therein for establishing said protective pattern, and said collar being shiftable between an operative position surrounding said discharge port and an inoperative position spaced from said discharge port.

12. The firefighting device of claim 11, in which said collar includes a chamber adapted to communicate with and receive fire extinguishing agent under pressure from said discharge port when said device is in operation and said collar is in said operative position, and said orifice means comprises at least one orifice in said collar and arranged so that the flow therefrom is directed generally axially outwardly from said collar and at least one other orifice in said collar and arranged so that the flow therefrom is directed generally radially outwardly from said collar and so as to impinge upon the flow from said first mentioned orifice to provide said protective pattern.

13. The firefighting device of claim 12, in which a plurality of said first and second mentioned orifices are provided in said collar, the orifice of said first and second mentioned sets being circumferentially spaced and arranged so that the jets from the orifices of said second mentioned set impinge upon the jets from the orifices of said first mentioned set, whereby the combined flows from said orifices provide said protective pattern.

14. The firefighting device of claim 13, in which the angle subtended by the end ones of the orifices in said first and second circumferentially spaced sets is about 150°.

15. The firefighting device of claim 11, in which said collar is rotatable relative to said tubular penetrating member, whereby the position of said enlarged pattern may be changed to maximize protection to firefighters in proximity to the device.

16. The firefighting device of claim 15, in which said protective pattern has an angle of diversion of about 180°.

17. The firefighting device of claim 14, in which said plurality of said first mentioned orifices comprises a set of equidistantly circumferentially spaced upwardly inclined orifices and said plurality of said second mentioned orifices comprises a set of equidistantly circumferentially spaced downwardly inclined orifices with the second set of orifices being disposed above and in substantial radial alignment with the first set of orifices.

* * * * *